US005602439A

United States Patent [19]

Valone

[11] Patent Number: 5,602,439

[45] Date of Patent: Feb. 11, 1997

[54] DIAMOND-GRAPHITE FIELD EMITTERS

[75] Inventor: Steven M. Valone, Santa Fe, N.M.

[73] Assignee: The Regents of the University of California, Office of Technology Transfer, Alameda, Calif.

[21] Appl. No.: 196,343

[22] Filed: Feb. 14, 1994

[51] Int. Cl.[6] ..... H01J 1/02

[52] U.S. Cl. ..... 313/310; 313/309; 313/336; 313/351

[58] Field of Search ..... 313/309, 310, 313/336, 351, 495, 496, 346 R

[56] References Cited

U.S. PATENT DOCUMENTS

| | | | |
|---|---|---|---|
| 2,062,370 | 12/1936 | Miller | 250/27.5 |
| 3,866,077 | 2/1975 | Baker et al. | 250/49.5 |
| 3,883,760 | 5/1971 | Cunningham, Jr. | 313/55 |
| 4,143,292 | 3/1979 | Hosoki et al. | 313/336 |
| 4,728,851 | 3/1988 | Lambe | 313/309 |
| 5,010,249 | 4/1991 | Nishikawa | 250/306 |
| 5,129,850 | 7/1992 | Kane et al. | 445/24 |
| 5,138,220 | 9/1992 | Kirkpatrick | 313/309 |
| 5,138,237 | 8/1992 | Kane et al. | 315/349 |
| 5,141,460 | 8/1992 | Jaskie et al. | 445/24 |
| 5,180,951 | 1/1993 | Dworsky et al. | 315/169 |
| 5,199,918 | 4/1993 | Kumar | 445/50 |
| 5,256,888 | 10/1993 | Kane | 257/77 |
| 5,258,685 | 11/1993 | Jaskie et al. | 313/309 |

FOREIGN PATENT DOCUMENTS

| | | |
|---|---|---|
| 0609532 | 10/1994 | European Pat. Off. . |
| 2628584 | 12/1976 | Germany . |

OTHER PUBLICATIONS

S. C. Sharma et al., "Deposition of Diamond Films at Low Pressures and their Characterization by Positron Annihilation, Raman, Scanning Electron Microscopy, and X-Ray Photoelectron Spectroscopy," Appl. Phys. Lett. 56 (18) (30 Apr. 1990).

N. S. Xu et al.,, "Similarities in the Cold Electron Emission Characteristics of Diamond Coated Molybdenum Electrodes and Polished Bulk Graphite Surfaces," J. Phys. D: Appl. Phys. 26 (1993), 1776–1780).

Lttz, "Intense Microwave Pulses II", SPIE vol. 2154, (Jan. 1994), pp. 110/117, entitled Rep-rate Explosive Whisker Emission Cathode Investigations.

Wang et al., "Cold Field Emission from CVD Diamond Films Observed in Emission Electron Microscopy," 27(1991) Aug., No. 16, pp. 1459–1461.

Xu et al. "Field-Dependence of the Area-Densiity of 'Cold' Sites on Broad Area CVD Diamond Films" Electronics Letters, 2nd Sep. 1993, vol. 29, No. 18.

Kumer et al., "Amorphic Diamond Film Flat Field Emission Cathode," International Publication Date, Dec. 8, 1994.

Dotter et al., "Nucleation and Growth of Highly Transparent anocrystalline Diamond Films," Electrochemical Soc., Inc., pp. 746–752, 1993.

Roy et al., "Diamond Synthesis Via A Low-Pressure Solid-State-Source Process," Mat. Trd. Bull., vol. 28, pp. 861–866, 1993.

Ting et al., "Diamond-Infiltrated Carbon-Carbon Composites," Diamond and Related Materials, 2(1993) pp. 1069–1077.

Kumar et al., "Field-Emission Displays Based on Diamond Thin Films," SID 1993 Digest pp. 1009–1011.

Geis et al., "Diamond Cold Cathode," IEEE Electron Device Ltrs., vol. 12, No. 8, Aug. 1991, pp. 456–459.

Givargizov., "Growth of Diamond Particles on Sharpened Silicon Tips," Mat. Ltrs., vol. 18, No. 1.2, (Nov. 1993) pp. 61–63.

Stojanovic et al., "Cold Field Emission From CVD Diamond Films Observed In Emission Electron Microscopy," Electronics Ltrs. 1st Aug. 1991, vol. 27 No. 16 pp. 1459–1461.

Bajic et al., "Enhanced Cold-Cathode Emission Using Composite Resin-Carbon Coatings," J. Phys. D: Appl. Phys. 21 (1988).

CRC Handbook of Chemistry and Physics, 73rd Edition, CRC Press, 1992, pp 12–10.

*Primary Examiner*—Nimeshkumar Patel
*Attorney, Agent, or Firm*—Bruce H. Cottrell

[57] ABSTRACT

A field emission electron emitter comprising an electrode of diamond and a conductive carbon, e.g., graphite, is provided.

14 Claims, 2 Drawing Sheets

DIAMOND-GRAPHITE FIELD EMITTERS

FIELD OF THE INVENTION

The present invention relates to the technical area of the field emission of electrons and more particularly to field emission electron emitters of, e.g., graphite and diamond, and their use in electronic applications. This invention is the result of a contract with the Department of Energy (Contract No. W-7405-ENG-36).

BACKGROUND OF THE INVENTION

Field emission electron sources, often referred to as field emission materials or field emitters, can be used in a variety of electronic applications, e.g., vacuum electronic devices, flat panel computer and television displays, emission gate amplifiers, and klystodes. Field emitters of etched silicon or silicon microtips have been known (see Spindt et al., "Physical Properties of Thin Film Field Emission Cathodes", J Appl. Phys., vol. 47, pp. 5248, 1976), but require expensive and elaborate fabrication techniques. Additionally, such field emission cathodes suffer from relatively short lifetimes due to erosion of the emission surfaces from positive ion bombardment.

Others have deposited diamond coatings on silicon surfaces to use the intrinsic electronic properties of diamond, i.e., its negative or low electron affinity. Negative electron affinity means that conduction electrons can easily escape from a diamond surface into vacuum. For example, diamond has been deposited by chemical vapor deposition (CVD) upon silicon substrates for formation of field emitters (see Geis et al., "Diamond Cold Cathode", IEEE Electron Device Letters, vol. 12, no. 8, pp. 456–459, 1991). However, these attempts have yielded low current densities, estimated from about 0.1 to 1 amperes per square centimeter ($A/cm^{-2}$) for a diode current of 10 milliamperes (mA), these current densities requiring a high voltage for initial electron emission and accordingly, high power consumption. Recently, amorphic diamond thin films have been deposited upon substrates such as chrome or silicon by laser ablation (see Kumar et al., SID 93 Digest, pp. 1009–1011, 1993) to form field emitters. These field emitters have achieved current densities exceeding those achieved by the earlier etched silicon or silicon microtips, and have achieved light emission from a phosphor bombarded by electrons from such a diamond coated field emitting surface. In one such coating of diamond by CVD upon a silicon or molybdenum substrate, it was found that graphite impurities or graphite particle-like inclusions present from the diamond deposition may have resulted in improved field emission (see Wang et al., Electronics Letters, vol. 27, no. 16, pp. 1459–1461 (1991)).

Further work employing diamond in field emitters has been by Jaskie and Kane (see U.S. Pat. Nos. 5,129,850; 5,138,237; 5,141,460; 5,256,888; and 5,258,685). They describe, e.g., forming field emission electron emitters by providing a selectively shaped conductive/semiconductive electrode having a major surface, implanting ions as nucleation sites onto at least a part of the major surface of the conductive/semiconductive electrode, and growing diamond crystallites at some of the nucleation sites, to produce an electron emitter including a coating of diamond disposed on at least a part of the major surface of the selectively shaped conductive/semiconductive electrode. These emitters are essentially a Spindt-type microtip or cathode overcoated with diamond film. Also, Dworsky et al. (U.S. Pat. No. 5,180,951) have described an electron emitter employing a polycrystalline diamond film upon a supporting substrate of, e.g., silicon, molybdenum, copper, tungsten, titanium and various carbides, with the surface of the diamond film including a plurality of 111 crystallographic planes of diamond or 100 crystallographic planes to provide a low or negative electron affinity. Dworsky et al. teach that the supporting substrate can be substantially planar thereby simplifying the fabrication of the electron emitter.

Despite the recent advances, further improvements in current densities and electron emission efficiency of field emission electron emitters are believed necessary to reduce power consumption requirements in most applications. Other improvements are needed in reproducibility of the emitters, in the lifetimes of the emitters and in reduced fabrication costs of the emitters.

It is an object of the present invention to provide a field emitter material having high electron emission efficiency and low voltage requirements, i.e. low voltage switch-on requirements.

Another object of the present invention is to provide a field emitter material having a longer lifetime or longer period of operation in the face of positive ion erosion.

A further object of the present invention is to provide an easily fabricated field emitter.

Still another object of the present invention is to provide field emitter materials suitable for providing a variety of field emitter cathode geometries.

SUMMARY OF THE INVENTION

To achieve the foregoing and other objects, and in accordance with the purposes of the present invention, as embodied and broadly described herein, the present invention provides a field emission electron emitter comprising an electrode consisting essentially of a conductive carbon and diamond. Preferably, the conductive carbon is graphite. The present invention further provides a field emission electron emitter comprising an electrode consisting essentially of a conductive carbon and diamond-like carbon.

In one embodiment, the present invention involves a field emission electron emitter of a conductive carbon and diamond wherein said diamond is polycrystalline having a substantial portion of crystal sizes of less than about 1 micron in at least one dimension, preferably a major portion of crystal sizes of less than about 1 micron in at least one dimension. In another embodiment, the present invention involves a field emission electron emitter wherein said diamond includes at least some 111-oriented crystal planes, some 100-oriented crystal planes or a combination of both.

The present invention further provides an electronic device employing a conductive carbon-diamond composite electron emitter, e.g., a flat panel display including a cathode comprised of a conductive carbon substrate and a coating of diamond disposed thereon, an anode plate spaced apart from the cathode, a layer of a patterned conductive film situated upon a surface of the anode plate between the anode and cathode, and a layer of a phosphor capable of emitting light upon bombardment by electrons emitted by the conductive carbon-diamond composite cathode.

DETAILED DESCRIPTION

Figure 1:
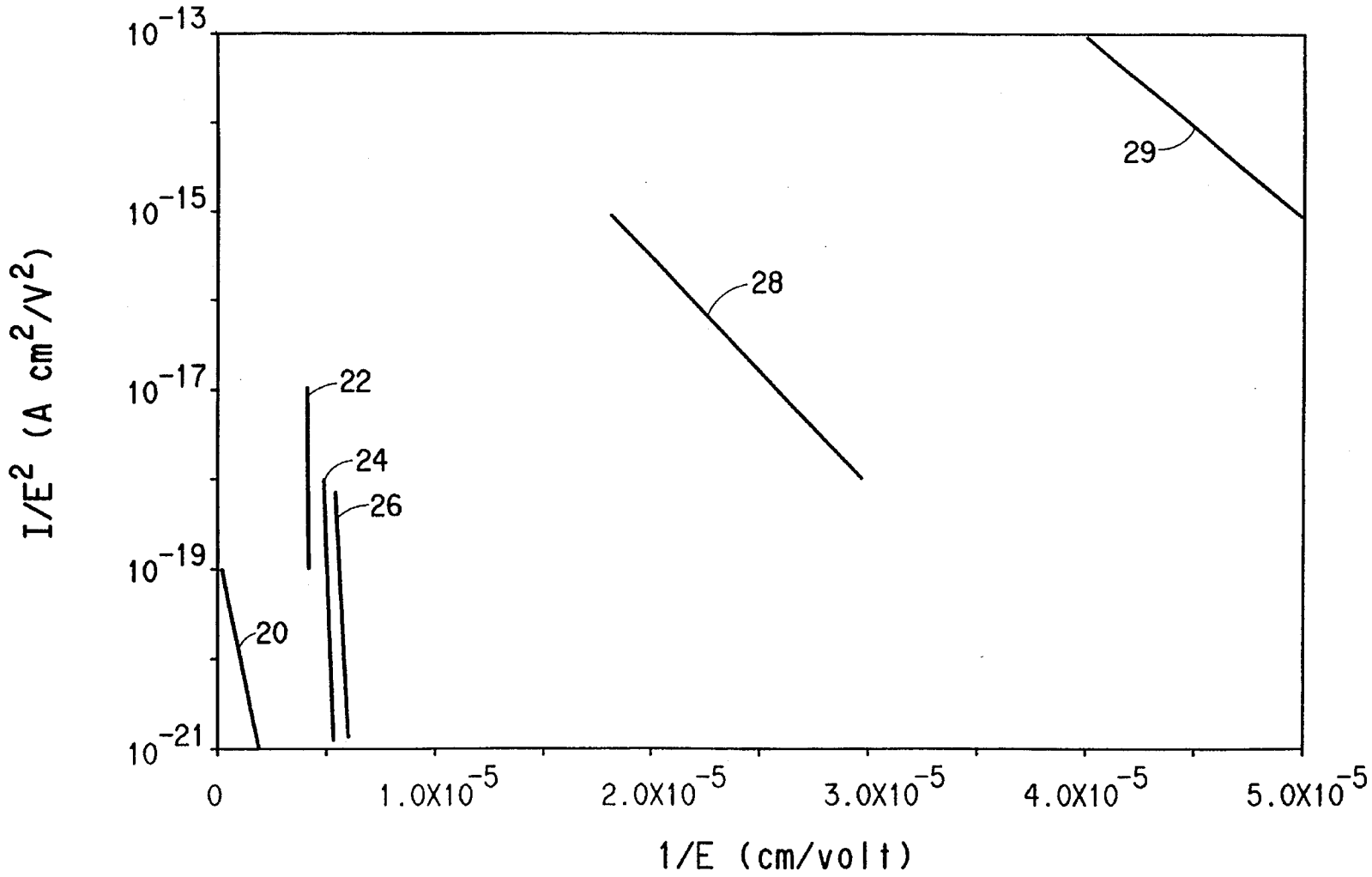
FIG. 1 shows comparative Fowler-Nordheim plots of field emission materials from the prior art and from the present invention.

The present invention is concerned with field emission materials also known as field emitters and field emission electron sources. In particular, the present invention concerns the use of diamond composites as field emission materials, such diamond composites of diamond and a conductive carbon material, and the use of such emitter materials in electronic applications.

Suitable diamond composites including, e.g., diamond coated-graphite, diamond-coated carbon, graphite with embedded diamond, or carbon with embedded diamond, preferably diamond coated-graphite, can provide for field emission materials with high current densities. Such diamond composites preferably include a sub-micron scale crystal structure of diamond, i.e., diamond having crystal sizes of generally less than about 1 micron in at least one crystal dimension. Within the sub-micron sized diamond crystals, such diamond crystals include at least some exposed 111-oriented crystal facets, some exposed 100-oriented crystal facets, or some of both. Another form of diamond having suitable sub-micron dimensions is commonly referred to as cauliflower-diamond which has fine grained balls as opposed to a pyramidal structure.

Diamond-like carbon with an appropriate short range order, i.e., a suitable combination of $sp^2$ and $sp^3$ bonding may also provide for field emission materials with high current densities in combination with a conductive carbon, such as graphite. It may also be possible to use a conductive carbon, such as graphite, coated with amorphic diamond via laser ablation as described by Davanloo et al. in J. Mater. Res., Vol. 5, No. 11, Nov. 1990.

One manner of providing a diamond-conductive carbon composite is to coat, e.g., a graphite substrate, with diamond via a plasma CVD process with microwave excitation or hot filament excitation of a feed gas to generate the plasma. The feed gas mixture generally includes a minor amount of a carbon-containing gas such as methane, ethylene, carbon monoxide and the like and a major amount of hydrogen. However, graphite is known to be a difficult material to coat with diamond via CVD due to premature etching away of the graphite substrate by atomic hydrogen in the plasma. Accordingly, any graphite substrate to be diamond-coated is pre-treated to increase the density of nucleation sites of the diamond upon the graphite surface thereby increasing the rate of diamond deposition which can serve to protect the graphite from etching. As the pre-treatment, the graphite can be abraded with a material having a Mohs hardness harder than graphite, e.g., diamond powder or grit, in a liquid medium, preferably an organic solvent medium such as methanol.

Another manner of providing a diamond-conductive carbon composite is to admix, e.g., graphite and diamond powder in a suitable binder material. In such an admixture, the diamond powder preferably includes some portion of crystals with exposed 111-oriented crystal facets, some portion of crystals with exposed 100-oriented crystal facets, or some of both. After such an admixture is formed and cured within a suitable binder, additional diamond surfaces may be exposed by treatment with a suitable etchant that can remove some graphite and binder material from outer diamond surfaces.

Still another manner of providing a diamond-conductive carbon composite would be by partially converting graphite or another form of carbon into diamond in accordance with the description of Roy et al., "Diamond Synthesis Via a Low-Pressure Solid-State-Source Process" Mat Res Bull , vol. 28, pp. 861–866 (1993). Whereas Roy et al. emphasize essentially quantitative conversion, less than quantitative or partial conversion may be accomplished by a reduction of reaction time to yield, e.g., a graphite-diamond composite.

The diamond or diamond-like carbon materials forming the composite with the conductive carbon, e.g., graphite for the present field emission emitter materials should have a low or negative electron affinity thereby allowing electrons to easily escape from the diamond or diamond-like carbon surface. Diamond typically has several low index facets of low or negative electron affinity, e.g., 100-faceted diamond has a low electron affinity whereas 111-faceted diamond has a negative electron affinity. Diamond-like carbon may preferably be n-type doped with, e.g., nitrogen or phosphorus, to provide more electrons and reduce the work function or electron affinity of the material.

Various geometries of the diamond-conductive carbon composite are possible in forming the field emitters. The diamond-conductive carbon composite can be planar or flat, can be shaped as a fiber, i.e., with one dimension substantially greater than the other two dimensions, or may be configured as otherwise desired for arrangement as the cathode into a particular field emission electron emitter assembly. For example, the cathode may be shaped for optimal performance in combination with any particularly shaped anode. When the composite is shaped as a fiber, such a fiber can have any shape fiber cross-section limited only by the design of the spinneret. Additionally, variations in the shape of the spinneret may lead to desirable internal molecular microstucture within the fibers themselves. As fibers, the conductive carbon-diamond composite can be arranged as a woven fabric spread out in a plane parallel to an anode. In another fashion, fiber tips of a conductive carbon-diamond composite can be arranged perpendicular to the plane or surface of the anode. Conductive carbon-diamond fibers may also be bundled together in the fashion of multiple filaments and may be woven like a thread or yarn either in a plane parallel to or perpendicular to the plane or surface of the anode.

Where the conductive carbon-diamond composite is shaped as fibers for use as field emission materials, such fibers can generally be a composite of, e.g., a graphite core, with a thin layer of diamond surrounding the graphite core. Generally, such graphite-diamond composite fibers will have a total diameter of from about 1 micron to about 30 microns, preferably from about 3 microns to about 15 microns. The diamond layer or coating in such a composite fiber can generally be from about 100 Angstroms to about 50,000 Angstroms (5 microns), preferably from about 1,000 Angstroms to about 20,000 Angstroms, more preferably from about 1,000 Angstroms to about 5,000 Angstroms. Generally, the diamond layer is made as thin as possible while yielding a continuous coating upon the conductive carbon, e.g., graphite.

In a coated conductive carbon substrate, the outer diamond or diamond-like carbon layer preferably has rough jagged edges such that a series of spikes and valleys is present upon the diamond or diamond-like carbon layer. In diamond coatings, this surface morphology results from the microcrystalline structure of the diamond material. It may be preferred that a minor amount of graphite be situated between at least a portion of said diamond crystals within said diamond coating for best results. It may also be preferred that diamond grow via CVD develop in columnar fashion due to slight misalignment between the growing crystals. This misalignment may also promote the development of the rough jagged edges of the diamond morphology.

While not wishing to be bound by the present explanation, it is believed that the performance of the diamond in achieving the observed current densities can result from a combination of factors including, e.g., greater nucleation density resulting from diamond nucleation properties of any graphite substrate, the presence of minor amounts of graphite impurities or occlusions between diamond microcrystals, the possibility of registry between atoms of graphite and diamond, i.e., atoms of diamond and graphite lining up to essentially an epitaxial-type position, and, in the case of fibrous shaped composites, the geometry of the diamond fiber itself in comparison to a flat surface emitter, i.e., the small radius of curvature of a fiber may contribute to an increase in the field effect.

It should be recognized that while diamond-like carbon is a type of conductive carbon, in the case of a diamond-like carbon composite with a conductive carbon material, that such a composite is envisioned as including a conductive carbon material characterized as a different material in some fashion from the diamond-like carbon. For example, while the conductive carbon material may also be a diamond-like carbon material, the diamond-like carbon material serving as the conductive carbon would differ in, e.g., electrical conductivity, hardness, energy bandgap, electron affinity and work function, from the diamond-like carbon material such the composite includes a combination of two types of materials.

Figure 3:
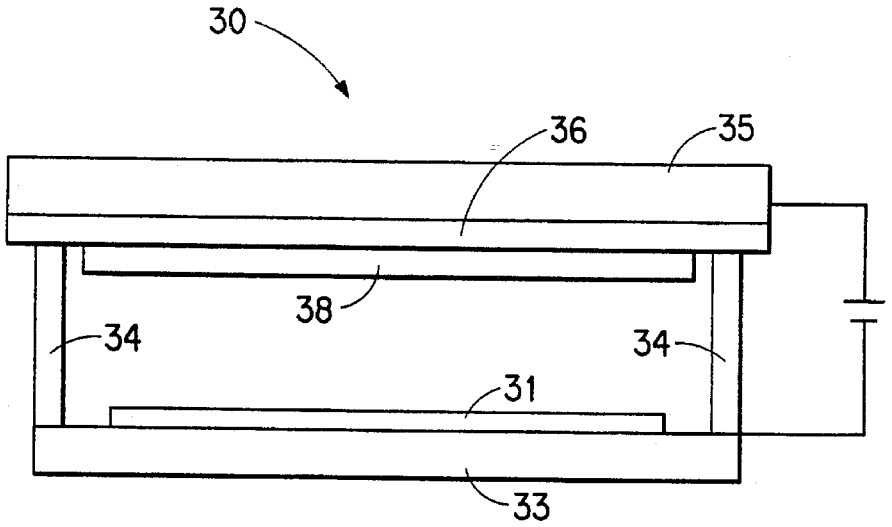
FIG. 3 shows a diode device employing the diamond-conductive carbon field emission materials of the present invention.

Fabrication of an exemplary electronic device, i.e., a diode device and in particular a field emission display device 30 as shown in FIG. 3, can be as follows. The diamond-graphite composite structure serves as the electron emitting cathode 31 for the device and is placed onto a patterned chrome film 32 upon a cathode glass 33 suitable for generating addressable pixels. Spaced apart by spacers 34 from this cathode is a glass anode plate 35 coated on the facing surface with a patterned layer of transparent indium-tin oxide (ITO) 36 and further having a layer of a phosphor 38, e.g., a ZnO phosphor, over the ITO layer. The patterned chrome film 32 and patterned ITO coating 36 are columns arranged, e.g., orthogonally, i.e., at rights angle to one another. This assembly is placed into a vacuum chamber at about $10^{-7}$ Torr and light emission is obtained upon applying 500 Volts (V) to the ITO anode columns while maintaining the chrome columns at ground.

The present invention is more particularly described in the following example which is intended as illustrative only, since numerous modifications and variations will be apparent to those skilled in the art.

EXAMPLE 1

Graphite fibers, prepared from polyacrylonitrile, having a thickness within the range of about 3 microns to about 15 microns were pre-cleaned and abraded in a methanol suspension of diamond paste with diamond particle sizes in the range of about 0.25 microns to about 1.0 micron. The suspension of fibers was ultrasonically vibrated for between 5 and 60 minutes to cause abrasion of the fiber surface to occur. The fibers were removed from the suspension, blotted to remove much of the solvent and inserted into a deposition chamber for the microwave-assisted plasma CVD of diamond.

Diamond films were deposited by a standard microwave plasma deposition technique. Deposition parameters were maintained within the following ranges: Process Gas—from about 0.3 to 5.0 percent by volume methane in hydrogen, preferably about 0.6 percent by volume methane in hydrogen; Pressure—from about 10 to 75 Torr, preferably about 40 Torr; Substrate temperature—from about 470° to 1000° C., preferably about 900° C.; and, Microwave power—from about 700 to 1500 Watts, preferably about 1500 Watts.

Secondary electron micrographs taken after diamond deposition showed successful deposition of diamond on the graphite. The diamond films were from about 4 to 15 microns in thickness on the graphite fibers originally about 5 to 10 microns in thickness. Raman spectroscopy confirmed that the deposited film was diamond having a sharp Raman peak at about 1332 $cm^{-1}$.

Figure 2:
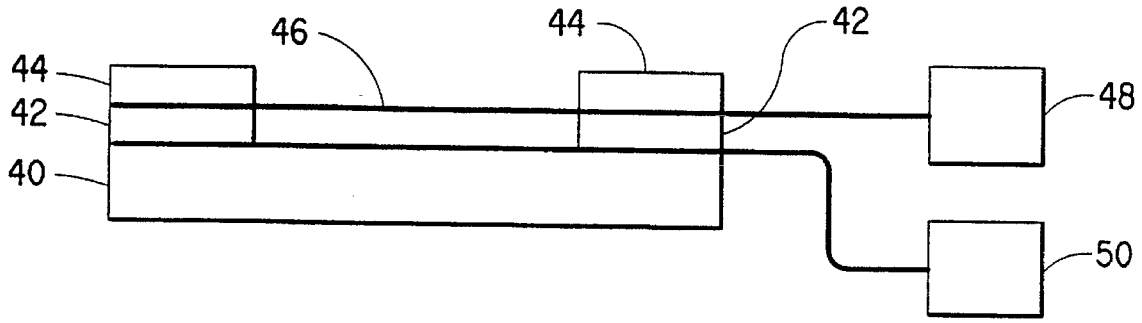
FIG. 2 shows a test assembly employed for measuring emission current on emitter samples.

A field emission set-up to measure emission current was fabricated as shown in FIG. 2. The set-up included a gold coated alumina collector pad 40 as the anode, glass coverslip spacers 42, glass coverslips 44 coated on one side with gold for electrical contact with the graphite-diamond composite fibers 46 as the cathode (a bundle of about 40 to 50 filaments), a 3 kV power supply 48 (a commercially available Keathly 247 High Voltage Supply) connected to the fibers 46, and an electrometer 50 (a commercially available Keathly 617 Electrometer) connected to the collector pad 40. The spacing between the fibers 46 and the collector pad 40 was about 20 to 40 microns. This entire setup was placed into a vacuum chamber which was pumped down to a base pressure of $2\times10^{-7}$ Torr prior to commencing field emission measurements. Typically, the emission current dropped with time for a few minutes and then reached a steady state after which no further decrease in the emission current was observed even after several hours of emission. The measured emission current was this steady state current. Emission current measurements were made at a number of voltages and plotted as a Fowler-Nordheim plot as shown in FIG. 1. In FIG. 1, plots 20, 22, 24, and 26 are taken from in Kumar et al. (FIG. 1 at p. 1010), SID 93 Digest, pp. 1009–1011, 1993. Plot 28 is with the diamond-graphite composite field emitter of the present example and shows low voltage switch-on requirements as indicated by the x-coordinate and shows excellent current densities as indicated by the y-coordinate.

EXAMPLE 2

Graphite fibers as in example 1 were coated with diamond using hot filament CVD. The resultant diamond-coated graphite fiber yielded emission current measurements shown as plot 29 in FIG. 1.

Although the present invention has been described with reference to specific details, it is not intended that such details should be regarded as limitations upon the scope of the invention, except as and to the extent that they are included in the accompanying claims.

What is claimed is:

1. A field emission electron emitter comprising an electrode consisting essentially of a conductive carbon and diamond wherein said diamond is a coating upon a substrate of said conductive carbon.

2. The field emission electron emitter of claim 1 wherein said diamond is polycrystalline having a substantial portion of crystal sizes of less than about 1 micron in at least one dimension.

3. The field emission electron emitter of claim 1 wherein said diamond includes minor amounts of a conductive carbon between at least a portion of diamond crystals present within said diamond coating.

4. A field emission electron emitter comprising an electrode including a conductive carbon substrate and a diamond coating disposed thereon.

5. The field emission electron emitter of claim,4 wherein said diamond is polycrystalline having a substantial portion of crystal sizes of less than about 1 micron in at least one dimension.

6. The field emission electron emitter of claim 4 wherein said diamond includes minor amounts of a conductive carbon between at least a portion of diamond crystals present within said diamond coating.

7. A field emission electron emitter comprising an electrode consisting essentially of a conductive carbon and diamond-like carbon, wherein said diamond-like carbon is a coating upon a substrate of said conductive carbon.

8. The field emission electron emitter of claim 7 wherein said diamond-like carbon includes an ordered arrangement of atoms less than about 10 nanometers in any direction.

9. The field emission electron emitter of claim 8 wherein said diamond-like carbon includes minor amounts of a conductive carbon between at least a portion of diamond-like carbon crystals present within said diamond-like carbon coating.

10. A field emission electron emitter comprising an electrode including a conductive carbon substrate and a diamond-like carbon coating disposed thereon.

11. The field emission electron emitter of claim 10 wherein said diamond-like carbon includes an ordered arrangement of atoms less than about 10 nanometers in any direction.

12. The field emission electron emitter of claim 10 wherein said diamond-like carbon includes minor amounts of a conductive carbon between at least a potion of diamond-like carbon crystals present within said diamond-like carbon coating.

13. In an electronic which employs field emission of electrons, said device including a cathode having an electron emitting surface, and an anode spaced apart from said cathode, the improvement wherein the cathode having an electron emitting surface consists essentially of a conductive carbon and diamond wherein said diamond is a coating disposed upon a shaped substrate of said conductive carbon.

14. In an electronic device which employs field emission of electrons, said device including a cathode having an electron emitting surface, and an anode spaced apart from said cathode, the improvement wherein the cathode having an electron emitting surface consists essentially of a conductive carbon and diamond-like carbon, wherein said conductive carbon is carbon and diamond-like carbon, wherein said conductive carbon is a shaped substrate and said diamond-like carbon is a coating disposed upon said shaped substrate.

* * * * *